US008074552B1

(12) United States Patent
Imholt et al.

(10) Patent No.: US 8,074,552 B1
(45) Date of Patent: Dec. 13, 2011

(54) FLYER PLATE ARMOR SYSTEMS AND METHODS

(75) Inventors: Timothy J. Imholt, Richardson, TX (US); Alexander F. St. Claire, Dallas, TX (US); Michael L. Noland, Dallas, TX (US)

(73) Assignee: Raytheon Company, Waltham, MA (US)

( * ) Notice: Subject to any disclaimer, the term of this patent is extended or adjusted under 35 U.S.C. 154(b) by 345 days.

(21) Appl. No.: 12/173,740

(22) Filed: Jul. 15, 2008

Related U.S. Application Data

(60) Provisional application No. 61/049,688, filed on May 1, 2008.

(51) Int. Cl.
*F41H 5/02* (2006.01)

(52) U.S. Cl. ..... 89/36.01; 89/36.02; 89/904

(58) Field of Classification Search ..... 89/36.01, 89/36.02, 36.04, 36.05, 36.07, 36.08, 36.09; 109/49.5, 81
See application file for complete search history.

(56) References Cited

U.S. PATENT DOCUMENTS

| | | | | | |
|---|---|---|---|---|---|
| 4,326,468 | A * | 4/1982 | King et al. | 109/49.5 |
| 4,741,244 | A * | 5/1988 | Ratner et al. | 89/36.17 |
| 5,070,764 | A * | 12/1991 | Shevach et al. | 89/36.17 |
| 5,214,235 | A * | 5/1993 | Froeschner | 89/36.13 |
| 5,370,034 | A * | 12/1994 | Turner et al. | 89/36.02 |
| 5,398,592 | A * | 3/1995 | Turner | 89/36.08 |
| 5,499,568 | A * | 3/1996 | Turner | 89/36.08 |
| 5,576,508 | A * | 11/1996 | Korpi | 89/36.01 |
| 5,792,974 | A * | 8/1998 | Daqis et al. | 89/36.02 |
| 5,905,225 | A * | 5/1999 | Joynt | 89/36.02 |
| 6,082,240 | A * | 7/2000 | Middione et al. | 89/36.08 |
| 2004/0094026 | A1 * | 5/2004 | Efim et al. | 89/36.02 |
| 2004/0255768 | A1 * | 12/2004 | Rettenbacher et al. | 89/36.02 |
| 2007/0144337 | A1 * | 6/2007 | Zhang et al. | 89/36.01 |
| 2010/0005955 | A1 * | 1/2010 | Ohnstad et al. | 89/36.02 |

* cited by examiner

*Primary Examiner* — Bret Hayes
(74) *Attorney, Agent, or Firm* — Baker Botts L.L.P.

(57) ABSTRACT

In accordance with an embodiment of the present disclosure, a protective armor system may include a first armor layer. The protective armor system may also include a plate that is detachably coupled to the first armor layer. The protective armor system may also have a second armor layer that is separated from the plate by a gap. When the plate is struck by a projectile, it may be operable to increase the surface area of the tip of the projectile as the projectile accelerates the plate through the gap.

20 Claims, 2 Drawing Sheets

FLYER PLATE ARMOR SYSTEMS AND METHODS

RELATED APPLICATION

This application claims the benefit of U.S. Provisional Application Ser. No. 61/049,688 filed May 1, 2008, entitled Systems and Methods for Mitigating Explosively Formed Penetrators.

TECHNICAL FIELD

The present invention relates generally to protection systems, and more particularly to lightweight armor that may withstand being struck by an explosively formed penetrator.

BACKGROUND

Explosively formed penetrators or explosively formed projectiles (EFPs) may be a deadly threat on a battlefield. EFPs may be able to penetrate the armor of an armored vehicle. The penetration of the armor may cause behind armor effects, such as spall. Spall is the armor fragments that break away from the armor of a vehicle as an EFP penetrates it. These armor fragments may be extremely hot and may be accelerated to extremely high velocities. Therefore, these fragments may hit and damage equipment and injure or kill personnel within a vehicle.

An EFP may be capable of penetrating a thickness of armor that is equal to the diameter of the EFP's charge. An EFP may penetrate by exhibiting fluid-like behavior that causes the EFP to take the shape of a penetrator. This formation is due to the explosive force and the shock wave acting on a metal liner that is part of the EFP. Because an EFP is capable of penetrating thick armor from a distance, equipping a vehicle with enough armor to protect against the threat of an EFP may cause the vehicle to be overweight, and thus be less effective on the battlefield.

SUMMARY

In accordance with an embodiment of the present disclosure, a protective armor system may include a first armor layer. The protective armor system may also include a plate that is detachably coupled to the first armor layer. The protective armor system may also have a second armor layer that is separated from the plate by a gap. When the plate is struck by a projectile, it may be operable to increase the surface area of the tip of the projectile as the projectile accelerates the plate through the gap.

Technical advantages of particular embodiments of the present disclosure may include a system that adds mass and surface area to an EFP. This added mass and surface area may decrease the energy of the EFP and may cause it to be a less effective penetrator.

Further technical advantages of particular embodiments of the present disclosure may include an armor system that is lighter weight than conventional armor. This lightweight armor system may be capable of protecting against a similar threat as a heavier conventional armor system. In particular, flyer plate armor in accordance with the present disclosure may protect against an EFP, while still effectively protecting against other projectile threats, such as bullets.

Other technical advantages will be readily apparent to one of ordinary skill in the art from the following figures, descriptions, and claims. Moreover, while specific advantages have been enumerated above, various embodiments may include all, some, or none of the enumerated advantages.

BRIEF DESCRIPTION OF THE DRAWINGS

A more complete understanding of the present embodiments and advantages thereof may be acquired by referring to the following description taken in conjunction with the accompanying drawings wherein.

DETAILED DESCRIPTION

Figure 1:
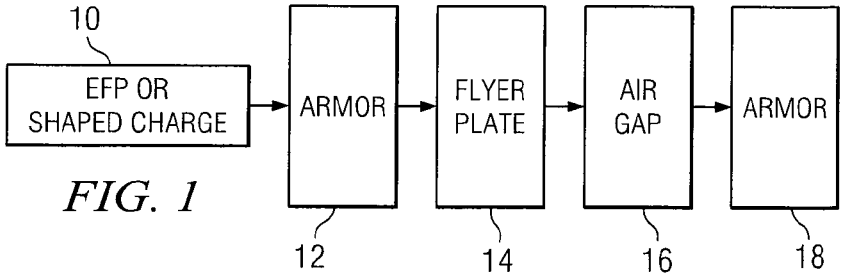
FIG. 1 illustrates a functional block diagram of a flyer plate armor system in accordance with an embodiment of the present disclosure.

Particular embodiments of the disclosure and their advantages are best understood by reference to FIGS. 1-3B.

On the battlefield, explosively formed penetrators (EFPs), also called explosively formed projectiles, are a serious threat to equipment and personnel. EFPs may have the ability to pierce through the armor of a vehicle and injure or kill the occupants inside. When the armor is pierced by the EFP, spall may result. Spall may be extremely dangerous or deadly to personnel in the armored vehicle. Spall refers to the fragments of armor that the EFP may cause to break off and accelerate into the interior of the vehicle. This material may be extremely hot and may be moving at an extremely high velocity. Thus, it may seriously injure personnel or damage equipment that it strikes.

EFPs may be capable of penetrating extremely thick and heavy armor. Therefore, merely adding more armor layers to protect against an EFP may result in a vehicle that is overweight and less effective on the battlefield. In accordance with a particular embodiment of the present disclosure, lightweight armor may be capable of stopping an EFP or significantly reducing its destructive capability.

High explosives may be extremely powerful because of their ability to rapidly release energy in the form of heat and pressurized gas. The extremely fast rate that this energy may be discharged gives a high explosive its strength. When this energy is discharged, shock waves may form. A shock wave may occur when a large amount of energy is released into a small space. The energy may compress the neighboring air or surrounding material and increase its velocity. This compressed air may then rapidly propagate outward and create a shock wave.

When a high explosive is detonated, the explosion may begin at a small portion of the edge of the explosive. This explosion may create a shock wave that may propagate through the rest of the explosive. When this shock wave comes in contact with a portion of the high explosive that has not yet exploded, the shock wave will detonate the unexploded explosive. Thus, the additional explosion will cause the shock wave to increase in velocity.

By exploiting the geometry of a high explosive, a more powerful and more focused blast may be accomplished. EFPs utilize geometry of the unexploded explosive to create an explosion that can form a material into a penetrating configuration at the same time it is accelerated by the explosion.

Inertial forces of a material that is being propelled by an explosion from rest to a hypervelocity may affect the molecular structure of the material. Hypervelocity may be over 6,700 miles per hour. The acceleration from rest to this hypervelocity may be extremely high, thus generating extremely high inertial forces. These inertial forces may be significantly greater than the molecular forces holding the particular material together. As a result, the material may behave similar to a liquid with the dominating inertial forces guiding the flow of the material. Inertial forces causing a material to behave similar to a liquid is a basic principle of EFP formation.

An EFP may be a specific type of shaped charge designed to pierce armor from a distance. There may be a wide range of EFP designs, depending on the desired effect. An EFP may be able to pierce a thickness of steel armor equal to the diameter of the charge. It may also be effective when fired at a target from a distance. The shape of an EFP may be a semi-spherical dish. The semi-spherical dish may be covered by a metal liner. The metal liner may be copper, or any other suitable metal that will behave similar to a fluid when subjected to extremely high inertial forces.

When an EFP is detonated and the shock wave that detonates the charge reaches the metal liner, it may cause the metal liner to behave similar to a fluid and form a penetrating shape. As the metal liner is formed into a penetrator by the shock wave, the EFP's unexploded geometry may allow it to form into a single slug, as opposed to a separate slug and jet that may result with other types of shaped charges. A minor jet may be present near the tip of the EFP, but typically, the slug will not have a defined shape of a penetrator. The penetrating characteristic of an EFP may result due to the armor that is being penetrated by the EFP.

The metal liner of an EFP may be concentrated together such that, as it is being formed, the metal liner does not break apart before it reaches the target. The geometry of the curvature of the liner before detonation may control the shape an EFP becomes after detonation. Thus, a shape may be found to provide optimum aerodynamic and penetration attributes.

The shape of an EFP may be important to its ability to penetrate. An EFP with a smaller surface area may penetrate easier. This may be the result of the higher stress that the EFP imparts over a smaller surface area of the armor it is penetrating. This may result in greater penetration. In accordance with an embodiment of the present disclosure, the potentially penetrating surface area of the tip of the EFP may be increased by a flyer plate embedded within an armor system.

An EFP may travel at over 11,000 miles per hour, which may be well into hypervelocity regimes. A shock wave that accelerates the metal liner to these types of velocities may cause the metal liner to behave as if it were a fluid. The fluid effects caused by the inertial forces generated by the explosion may also contribute to the EFP's ability to penetrate.

Due to the fluid-like characteristics of the EFP as it penetrates armor, the armor may exert a drag force upon the tip of the EFP. However, instead of transmitting this force throughout the entire EFP, as would occur if the EFP were a solid, the tip portion of the EFP that is subjected to the drag force, may fall away from the sides of a hole being created in the armor. Thus, instead of slowing down the entire EFP, only a small portion of the EFP may experience drag from the armor while the rest of the EFP maintains its velocity as it travels through the hole in the armor.

Also, as the portion of the metal tip gets dragged backwards by the armor, the EFP may reshape itself into a better penetrator. This may result when the edges of the EFP may be somewhat consumed as they are pushed to the rear of the EFP. Thus, the EFP becomes a thinner, more effective penetrator. The EFP effectively slides through the hole in the armor, as opposed to having large friction forces from the armor slow the entire EFP. Thus, the EFP effectively lubricates the armor walls through which it is penetrating.

Much of the damage from an EFP is due to the behind armor effects that they cause. When an EFP penetrates armor, it may launch spall into the vehicle. As discussed above, spall is the armor fragments that break away from the armor as the EFP penetrates it. These armor fragments may be extremely hot and accelerated by the EFP at extremely high velocities. As a result, these armor fragments may hit nearly everything within the personnel compartment of the vehicle and may cause extreme damage to the vehicle and injury or death to the occupants.

Damage from EFPs may also result from the overpressure blast that may send highly compressed air outwards at an extremely high velocity. The overpressure alone may cause blindness, deafness, and death. The overall effect of an EFP penetrating a vehicle may be similar to a fragmentation grenade being detonated within the vehicle.

In accordance with an embodiment of the present disclosure, an armor system may add mass and surface area to an EFP as the EFP penetrates the armor system. By adding mass and surface area to an EFP, its energy and destructive forces may be significantly reduced. In particular, the surface area of the tip of an EFP may be increased to reduce the EFP's penetrating ability. In addition, if the EFP does not penetrate the flyer plate, then it will not be able to reshape into a better penetrator.

FIG. 1 is a block diagram of a lightweight armor system employing a flyer plate in accordance with an embodiment of the present disclosure. EFP or shaped charge 10 may be detonated and may be propelled toward its intended target. An armor system may be between the target and the EFP or shaped charge 10. The armor system may include a first armor layer 12, and behind that there may be a flyer plate 14. Between the flyer plate 14 and a second armor layer 18 may be an air gap 16. These components may make up a lightweight armor system that is effective in reducing or eliminating the penetrating effects of an EFP.

Figure 2:
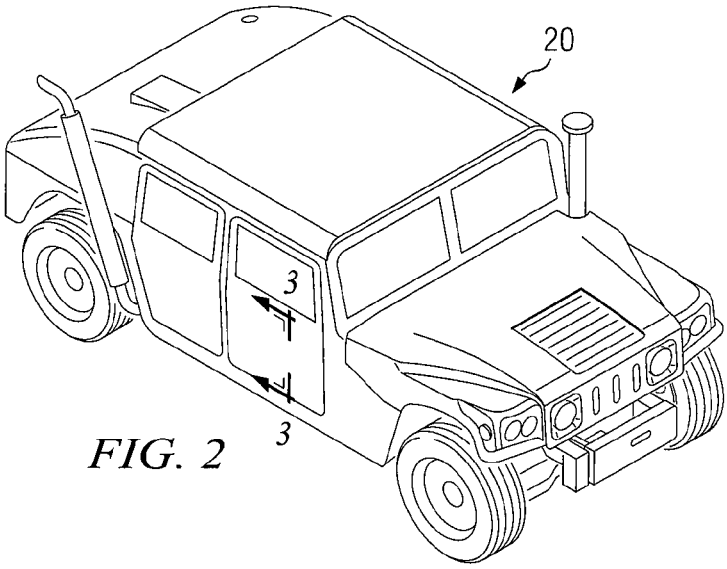
FIG. 2 illustrates a vehicle that may be equipped with a flyer plate armor system in accordance with an embodiment of the present disclosure.

FIG. 2 illustrates a vehicle 20 that may be equipped with a flyer plate armor system in accordance with the present disclosure. The flyer plate armor system may protect the occupants of vehicle 20 from the penetrating effects of an EFP for which they are a target. Vehicle 20 may be maneuverable and effective on a battlefield while it is equipped with a flyer plate armor system. Flyer plate armor system may include armor that is 10 inches thick and approximately 102 pounds per square foot. Other armor systems that do not employ a flyer plate may be considerably heavier and thicker. For example, conventional armor systems without a flyer plate may be 165 pounds per square foot and 18 inches thick. If vehicle 20 were equipped with this type of armor system, its maneuverability and effectiveness may be diminished.

Figure 3A:
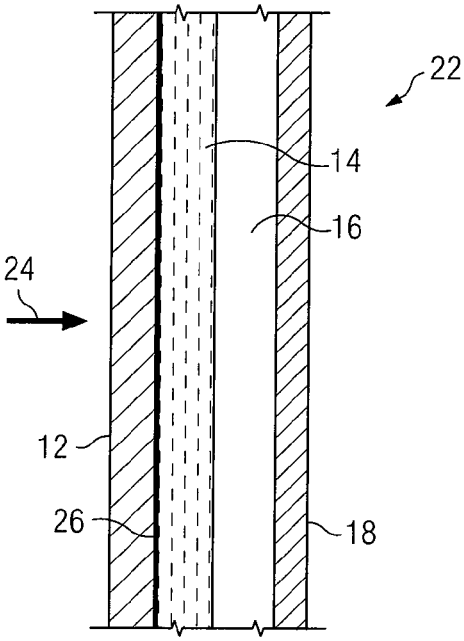
FIG. 3A illustrates a cross-section of a flyer plate armor system in accordance with an embodiment of the present disclosure.
Figure 3B:
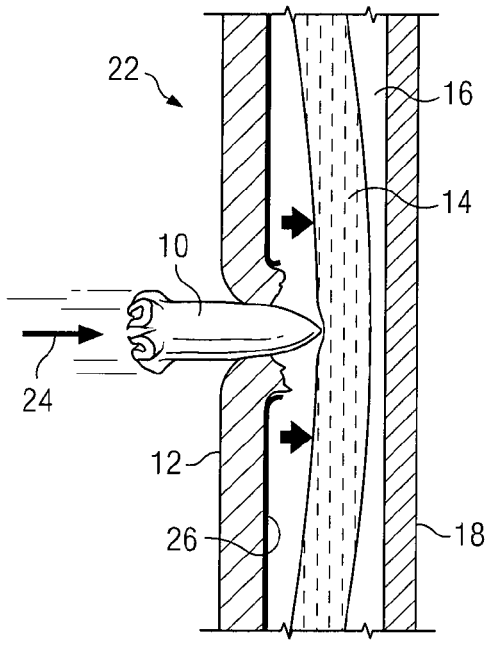
FIG. 3B illustrates the flyer plate armor system shown in FIG. 2A during impact with an explosively formed penetrator.

FIGS. 3A and 3B illustrate a cross-section of protective armor system 22 in accordance with an embodiment of the present disclosure. Protective armor system 22 includes a first armor layer 12 and a second armor layer 18. Armor layers 12 and 18 may be steel or any other suitable material for protecting against a projectile threat. Coupled to first armor layer 12 may be flyer plate 14. Flyer plate 14 may be detachably coupled to first armor layer 12, such that as an EFP penetrates first armor layer 12 and contacts flyer plate 14, flyer plate 14 may detach from first armor layer 12 and be accelerated by the EFP through gap 16. Second armor layer 18 may be separated from flyer plate 14 by gap 16. The protective armor system 22 may protect against an EFP that is traveling a direction 24 through the protective armor system 22.

FIG. 3B illustrates protective armor system 22 while it is being struck by EFP 10. EFP 10 penetrates first armor layer 12 and contacts flyer plate 14. Adhesive 26 releases due to the force of EFP 10 contacting flyer plate 14. Thus, EFP 10 accelerates flyer plate 14 through gap 16. Flyer plate 14 may also be curved by the impact of EFP 10 as shown. FIG. 3B illustrates flyer plate 14 immediately prior to its contacting second armor layer 18. Flyer plate 14 increases the surface area of EFP 10 and reduces its penetrating ability such that EFP 10 may not penetrate second armor layer 18 and the occupants and equipment behind protective armor layer 22 will be protected.

In accordance with an embodiment of the present disclosure, flyer plate 14 may be a flat, relatively thin body formed of any suitable material. In certain embodiments, it may be a plate formed from a sheet of aluminum and may be attached to the backside of first armor layer 12. The attachment may be such that flyer plate 14 may become detached and accelerate when it is struck by an EFP, as opposed to the EFP penetrating flyer plate 14. As flyer plate 14 is accelerated through gap 16, energy of the EFP will be used to accelerate flyer plate 14, leaving the EFP less energy to penetrate through the rest of the armor system. Also, as illustrated in FIG. 3B, EFP 10 may have a tip diameter of approximately one inch. When this one inch diameter tip contacts and accelerates flyer plate 14 without penetrating it, the surface area of the tip will be greatly increased. In certain embodiments, flyer plate may be 12 inches by 12 inches square. Thus, the surface area of a one inch radius circular tip of EFP 10 may be increased from a surface area of approximately 0.8 inches, to a surface area of approximately 144 inches. A projectile with a tip surface area of 144 square inches will be a much less effective penetrator than one with 0.8 square inches of surface area for its tip. Also, by increasing the mass of the EFP as it accelerates flyer plate 14, the velocity of the EFP may drop due to conservation of momentum. Thus, by adding flyer plate material to the EFP, its energy may be reduced by slowing its velocity, and its penetrating effects may be reduced by increasing its surface area.

Flyer plate 14 may be made from a wide variety of materials. For example, carbonized aluminum may make an effective flyer plate 14. Aluminum may be a good material for flyer plate 14 due to its light weight and ductile nature. The ductility of aluminum may allow flyer plate 14 to wrap around EFP 10 more effectively. The material of flyer plate 14 may be selected by considering the ductility and the weight of particular materials.

In certain embodiments, flyer plate 14 may be made of a bi-metal, or other material whose properties may change with depth. For example, if a more malleable or ductile material is located near the front of flyer plate 14 where EFP 10 will first contact flyer plate 14, the initial contact may not be as severe, and the EFP may be prevented from penetrating flyer plate 14. In other embodiments, flyer plate 14 may be formed with more ductile materials near the front and back of flyer plate 14, and less ductile materials in the middle of flyer plate 14. This may be effective if flyer plate 14 is in bending. This is because the material of flyer plate 14 which is in the middle of flyer plate 14 is the less ductile material. This portion of flyer plate 14 may be subjected to less deformation. This is because when flyer plate 14 is bent, the front portion of flyer plate 14 will be in compression and the rear portion of flyer plate 14 will be in tension. However, the center portion of flyer plate 14 may experience less compression and less tension. As a result, the center portion may no be deformed when flyer plate 14 is in bending.

As previously discussed, an armor system in accordance with embodiments of the present disclosure may include one or more flyer plates 14 that are configured to detach from the armor when struck by an EFP. Flyer plate 14 may be held in place by adhesive 26. In alternative embodiments, flyer plate 14 may be held in place by fasteners 27 such as pegs, bolts, clips, clamps, rivets, or any suitable fastening technique. Regardless of the method to attach flyer plate 14, the force required to detach flyer plate 14 should be less than the force required to penetrate it. Thus, the attaching means should fail before flyer plate 14 is pierced. Perforations 28 in flyer plate 14 may allow it to be detached easier from first armor layer 12, and may allow the detachment points to be finely controlled.

Flyer plate 14 may also be preloaded. A preloaded flyer plate 14 may be a curved sheet that is elastically forced into a flat position when it is attached to armor system 22. Once this sheet detaches as a result of the forces of the EFP, it may naturally conform to the shape of the EFP. Thus, the natural spring back of the preloaded sheet may help in shaping the material around the EFP so that it can better increase the surface area of the tip of the EFP.

In an alternate embodiment, flyer plate 14 may have a curved shape or a built-in obliquity. Similarly to the preloaded sheet, the shape of the curved sheet may assist in forming the sheet over the EFP. The curved sheet may also help position the sheet more closely to the tip of the EFP.

Behind flyer plate 14 may be gap 16 between flyer plate 14 and second armor layer 18. Gap 16 may be filled with any suitable gas that could occupy this area, for example air. A different gas may also be injected into gap 16 that alters the speed of sound. This may have an effect on the propagation of an EFP as it passes through the armor system. In addition, a liquid or solid may also occupy gap 16. Gap 16 may even include layered material such that it may exert changing resistive forces to help mold flyer plate 14 to the shape of the EFP without allowing it to penetrate. Gap 16 may be approximately one inch thick. In certain embodiments, gap 16 may be 1.5 inches thick. A larger gap 16 may protect against the threat of a larger EFP 10. A smaller air gap 16 may be effective against a smaller EFP 10.

Figure 3C:
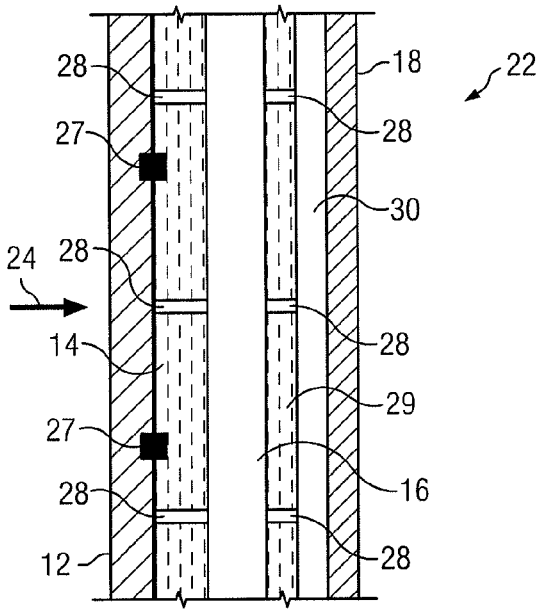
FIG. 3C illustrates a cross-section of a flyer plate armor system having more than one flyer plate, in accordance with an embodiment of the present disclosure.

In certain embodiments, there may be more than one flyer plate 14 and gap 16 as illustrated in FIG. 3C. For example, flyer plate 14 could be accelerated through gap 16. However, rather than contacting second armor layer 18, flyer plate 14 may contact a second flyer plate 29. After this occurs, flyer plate 14 and the second flyer plate 29 may be accelerated by EFP 10 through a second gap 30 before the EFP and the two flyer plates contact a second armor layer 18. This multi-flyer plate embodiment is not limited to two flyer plates, but rather could include three or more flyer plates. More flyer plates may protect against a stronger blast and/or a larger EFP.

Numerous other changes, substitutions, variations, alterations, and modifications may be ascertained by those skilled in the art and it is intended that the present invention encompass all such changes, substitutions, variations, alterations, and modifications as falling within the spirit and scope of the appended claims.

What is claimed is:

1. A protective armor system, comprising:

a first armor layer;

a plate detachably coupled to the first armor layer by a fastener, the fastener configured to fail after a projectile penetrates the first armor layer and contacts the plate but before the projectile penetrates the plate;

a second armor layer separated from the plate by a gap; and the plate being operable, when struck by a projectile, to detach from the first armor layer and be propelled by the projectile through the gap to increase a surface area of a tip of the projectile.

2. The protective armor system of claim 1, wherein the plate comprises aluminum.

3. The protective armor system of claim 2, wherein the first and second armor layers each comprises steel.

4. The protective armor system of claim 1, wherein the gap is approximately one inch.

5. The protective armor system of claim 1, wherein the fastener comprises an adhesive.

6. The protective armor system of claim 1, wherein the fastener is selected from the group consisting of pegs, bolts, clips, clamps, and rivets.

7. The protective armor system of claim 1, wherein the plate includes perforations.

8. The protective armor system of claim 1, wherein the projectile comprises an explosively formed penetrator (EFP).

9. The protective armor system of claim 1, wherein:

a depth of the plate is measured with respect to a potential impact surface of the plate; and the plate has a first property at a first depth, and a second property at a second depth, the first property being different from the second property.

10. The protective armor system of claim 9, wherein the second depth is greater than the first depth, and the first property is more ductile than the second property.

11. The protective armor system of claim 1, wherein the gap comprises a first and a second portion, and further comprising:

a second plate being separated from the plate by the first portion of the gap, and the second plate being separated from the second armor layer by the second portion of the gap.

12. The protective armor system of claim 1, wherein the plate is preloaded.

13. A method for protecting a target, comprising:

providing an armor system between a projectile and a target;

receiving by the armor system a force of a projectile;

detaching a plate embedded within the armor system due to the force of the projectile, the detaching occurring before the plate is penetrated, the plate detachably coupled to an armor layer by a fastener, the fastener configured to fail after the projectile penetrates the armor layer and contacts the plate but before the projectile penetrates the plate;

increasing a surface area of a tip of the projectile using the plate; and propelling, by the projectile, the plate through a gap within the armor system.

14. The method of claim 13, wherein a size of the plate is approximately 12 inches by 12 inches.

15. The method of claim 13, wherein the fastener comprises an adhesive.

16. An armored vehicle, comprising:

a vehicle having an armor system, the armor system comprising:

a first armor layer;

a plate detachably coupled to the first armor layer by a fastener, the fastener configured to fail after a projectile penetrates the first armor layer and contacts the plate but before the projectile penetrates the plate;

a second armor layer separated from the plate by a gap; and the plate being operable, when struck by a projectile, to detach from the first armor layer and be propelled by the projectile through the gap to increase a surface area of a tip of the projectile.

17. The armored vehicle of claim 16, wherein the plate comprises aluminum.

18. The armored vehicle of claim 17, wherein the first and second armor layers each comprises steel.

19. The armored vehicle of claim 16, wherein the gap is approximately one inch.

20. The armored vehicle of claim 16, wherein the fastener comprises an adhesive.

* * * * *